US007001062B2

(12) United States Patent
Lin

(10) Patent No.: US 7,001,062 B2
(45) Date of Patent: Feb. 21, 2006

(54) STRUCTURE OF MULTI-DIRECTIONS SOCKET FOR CHRISTMAS LIGHTS

(76) Inventor: Mei-Lu Lin, P.O. Box 697, Feng-Yuan City, Taichung Hsien (TW) 420

( * ) Notice: Subject to any disclaimer, the term of this patent is extended or adjusted under 35 U.S.C. 154(b) by 151 days.

(21) Appl. No.: 10/739,170

(22) Filed: Dec. 19, 2003

(65) Prior Publication Data

US 2005/0135119 A1 Jun. 23, 2005

(51) Int. Cl.
*H01R 33/00* (2006.01)

(52) U.S. Cl. ..... 362/654; 362/252; 362/227; 362/249

(58) Field of Classification Search ..... 362/654, 362/653, 227, 249, 252
See application file for complete search history.

(56) References Cited

U.S. PATENT DOCUMENTS 5,938,314 A * 8/1999 Lin ..... 362/249
6,022,125 A * 2/2000 Bartasevich et al. ..... 362/251
6,062,711 A * 5/2000 Huang ..... 362/391
6,086,220 A * 7/2000 Lash et al. ..... 362/244
6,086,410 A * 7/2000 Lin ..... 439/425

* cited by examiner

*Primary Examiner*—Renee Luebke
*Assistant Examiner*—David Makiya

(57) ABSTRACT

A structure of multi-directions socket for Christmas light includes a pair of first and a second sockets alternately and juxtaposedly integrated with one another toward opposite directions, a vertical slender common copper plate disposed between the sockets having a contact upper end engaged in an inner wall of the first socket and a hooked lower end retained in the second socket, a pair of electric wires each having a contact plate at inner end respectively inserted into the bottom and secured to an inner wall of each of the sockets positioned opposite to the contact upper end and the hooked lower end of the vertical slender copper plate and a pair of lamps respectively inserted into the rims of each of the socket and each having base, a bulb and a pair of lead-in wires attached to the outer surface of the base and respectively engaged with the contact plate of the electric wires and the contact upper end or the hooked lower end of the vertical slender copper plate in order to establish an electric circuit between the first and second sockets.

7 Claims, 9 Drawing Sheets

STRUCTURE OF MULTI-DIRECTIONS SOCKET FOR CHRISTMAS LIGHTS

BACKGROUND OF THE INVENTION

The present invention relates to Christmas light and/or reticulate Christmas lights and more particularly to a structure of multi-directions socket for Christmas light which may be reticulated into a network of varied shape in order to present the stepped three-dimensional effect.

Generally, the Christmas light is strung up into a string of lamps in which the sockets are apart from each other and connected by electric wires. Although, a combined sockets Christmas light was lately disclosed. But this type of light string caused more inconvenience because each of the sockets requires a pair of electric wires and the mass of electric wires caused more difficult than the conventional type to make a light string and could not break through on the shape making. Further, the conventional light string is also monotonous and can not make much shape variations except hang from a Christmas free or on equivalent objects that presents no specific effect.

My previous U.S. Pat. No. 5,938,314 and No. 5,913,597 tried to improve the above discussed defects. However, these two disclosures are of parallel alignment and can not present vertical three-dimensional effect. The shape variations are still not deserving.

SUMMARY OF THE PRESENT INVENTION

The present invention has a main object to provide a structure of multi-directions socket for Christmas light which the sockets are alternately and juxtaposely integrated with each other and toward opposing directions or integrated into an inverse V-shaped connection and/or L-shaped connection in order to present three-dimensional effect and to reticulate the networks of varied shapes.

Accordingly, the structure of multi-directions socket of the present invention comprises generally at least two sockets alternately and juxtaposedly integrated with each of other toward opposing directions. Each of the sockets includes a lamp, a copper plate and an electric wire.

The present invention will become more fully understood by reference to the following detailed description thereof when read in conjunction with the attached drawings.

DETAILED DESCRIPTION OF THE PREFERRED EMBODIMENT

Figure 1:
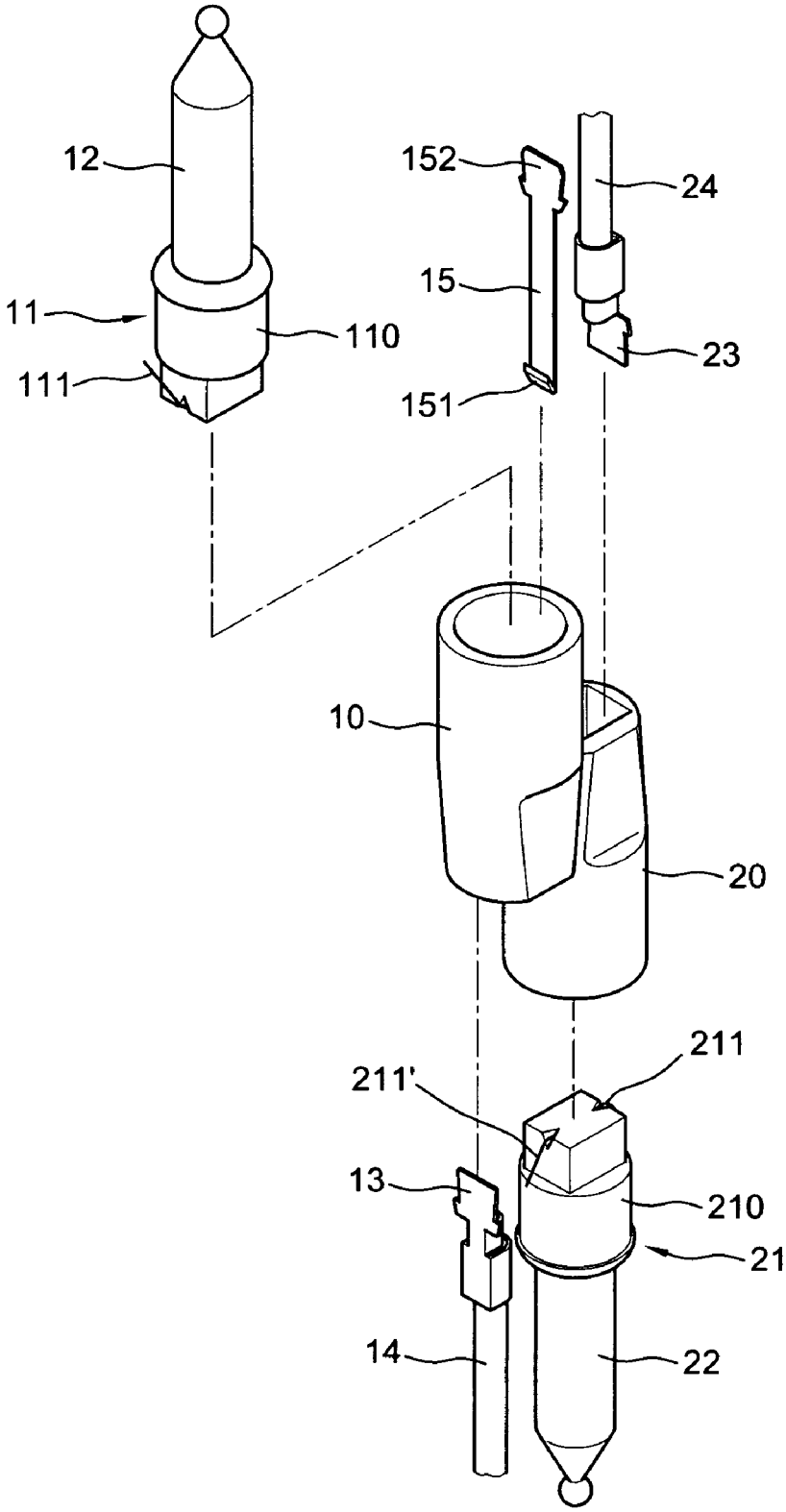
FIG. 1 is an exploded perspective view of a first embodiment of the multi-directions socket of the present invention.
Figure 2:
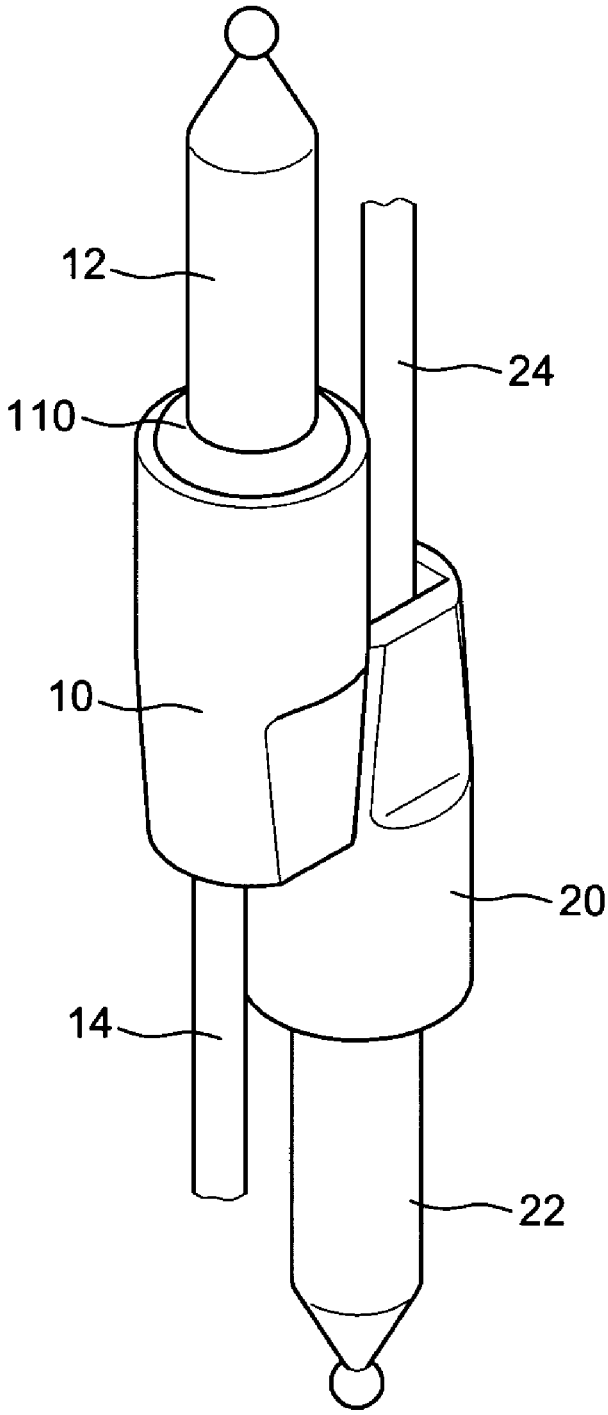
FIG. 2 is a perspective view to show the assembly of FIG. 1.
Figure 3:
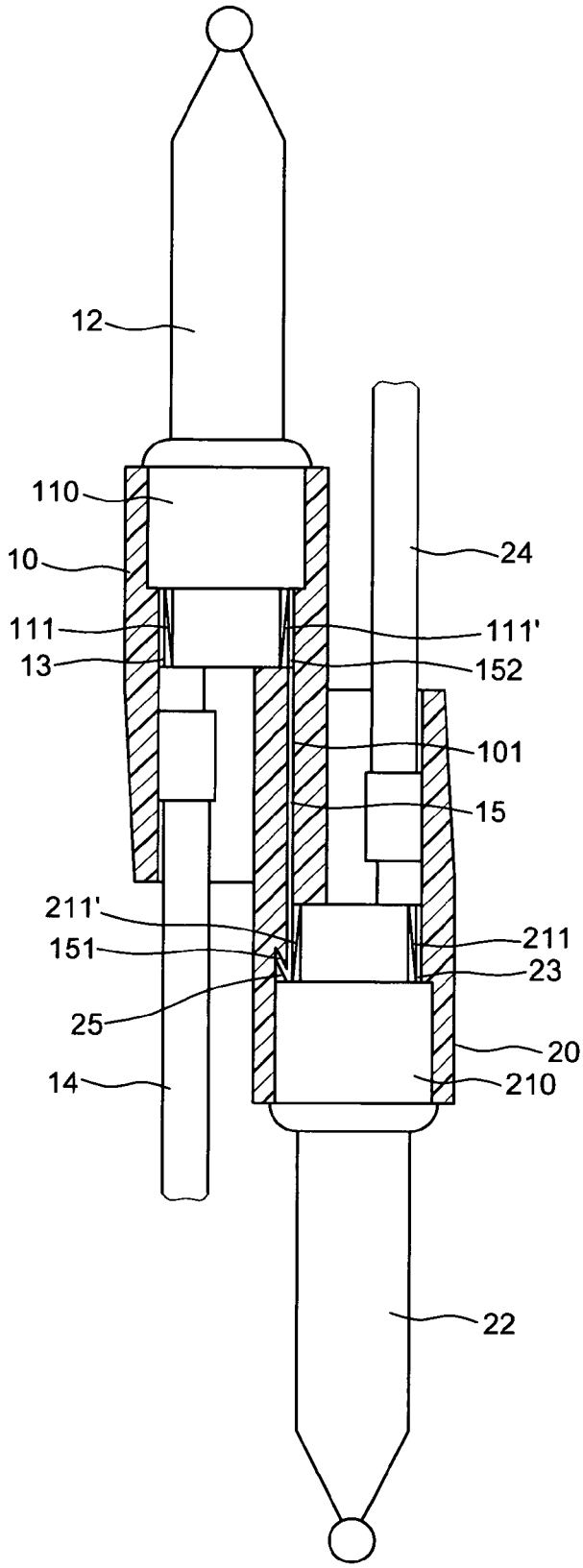
FIG. 3 is a sectional view of FIG. 2.

With reference to FIGS. 1, 2 and 3 of the drawings, the first embodiment of the multi-directions socket of the present invention comprises a first socket 10 and a second socket 20 alternately and juxtaposedly integrated with one another toward opposing directions, a slender slit 101 vertically formed between the sockets 10 and 20 communicating with the socket 10 and 20 for vertically disposing therein a slender copper plate 15 which has a hooked lower end 151 inserted into the second socket 20 and retained by a triangular retaining space 25 and an upper contact end 152 stopped against an inner wall of the first socket 10, a first electric wire 14 having a contact plate 13 at upper end inserted into the upper bottom and inlaid in an inner wall of the first socket 10 opposite to the contact end 152 of the slender copper plate 15, a second electric wire 24 having contact plate 23 at lower end inserted the bottom and inlaid in an inner wall of the second socket opposite to the hooked end of the slender copper plate 15, a first lamp 11 including a base 110 with a bulb 12 in the top inserted into the upper rim of the first socket 10 and a pair of lead-in wires 111 and 111' on the bottom respectively contacted with the contact plate 13 and the upper contact end 152 of the slender copper plate 15, a second lamp 21 including a base 210 with a bulb 22 in the lower end inserted into the lower rim of the second socket 20 and a pair of lead-in wires 211 and 211' on the bottom respectively contacted with the contact plate 23 and the hooked lower end 151 of the slender copper plate 15. Upon this arrangement, the slender copper plate 15 functioned as a bridge to connect the electric power between the two socket 10 and 20. Therefore, each of the sockets 10 and 20 saves an electric wire.

Figure 4:
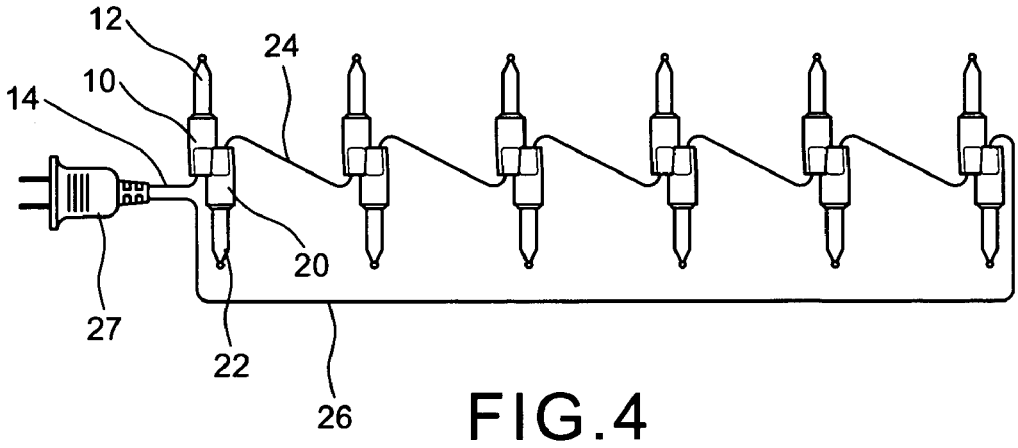
FIG. 4 is a plane view to show that a string of Christmas lights made of the multi-directions sockets of the first embodiment.
Figure 5:
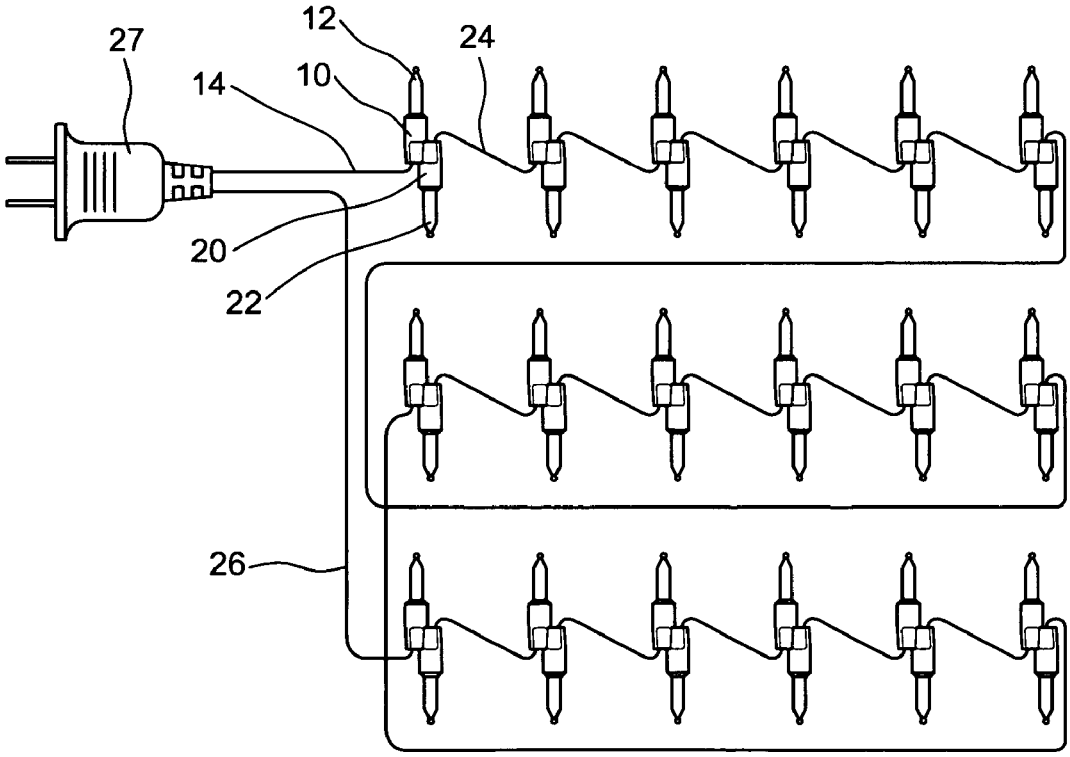
FIG. 5 is a plane view to show that several strings of Christmas lights are made of the multi-directions sockets of the first embodiment.

FIGS. 4 and 5 show that the multi-directions socket of the first embodiment can make a string of Christmas lights by connecting the electric wire 24 with each of the sockets, adding an electric wire 26 into the final socket and conjugating the electric wires 26 and 14 together into a plug 27 (as shown in FIG. 4).

If combines with several strings of Christmas lights together, the electric wire 26 must go around at first. Then respectively connects its two ends to a final socket of the first string and the plug 27 (as shown in FIG. 5). Due to that each of the sockets includes two lamps on the top and lower ends, it present more free-dimensional effect.

Figure 6:
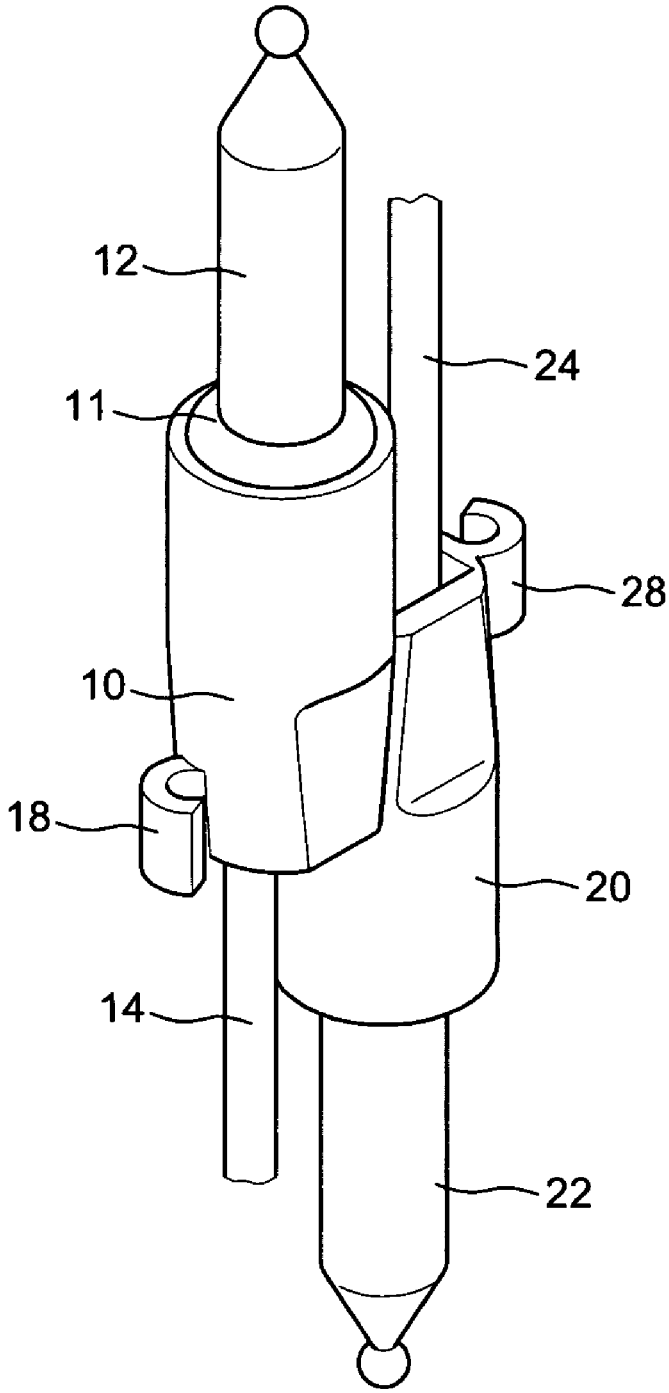
FIG. 6 is a perspective view of a second embodiment of the multi-directions socket of the present invention.
Figure 7:
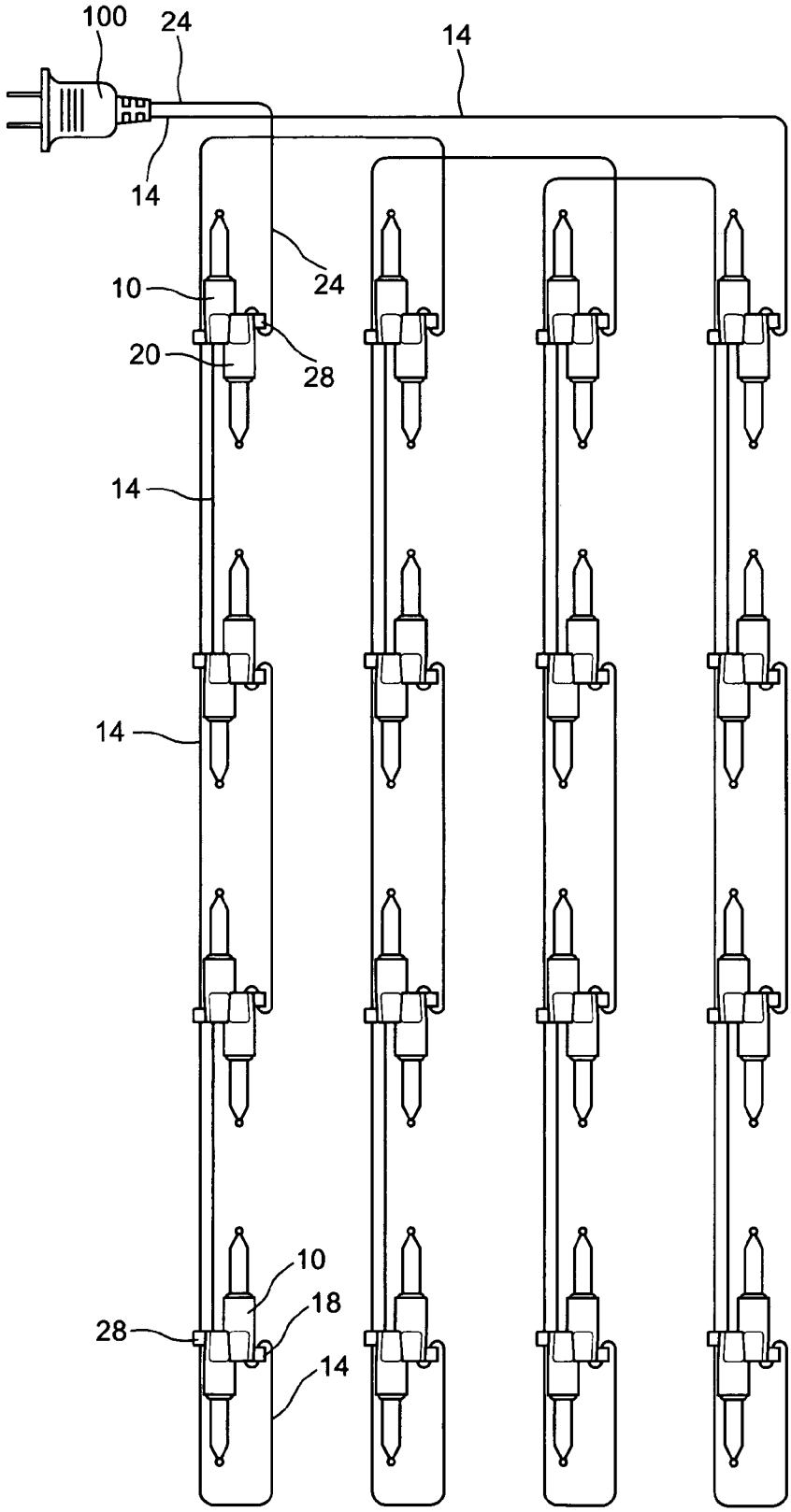
FIG. 7 is a plane view to show that the multi-directions sockets of the second embodiment are reticulated into a curtain configuration.

Referring to FIGS. 6 and 7, a second embodiment of the multi-directions socket of the present invention is provide. This embodiment is structurally and functionally most similar the first embodiment as described in FIGS. 1 to 5 and the above discussions are applicable in most in stances. The only change is that a pair hooks 18 and 28 are respectively added an outer periphery of the first and second sockets 10 and 20 for holding the electric wires 14 and 24. FIG. 7 shows how to go there electric wires 14 and 24 to make a curtain of Christmas lights by utilizing the sockets of the second embodiment.

The way is that hold the electric wire 24 in the hook 28 of an upmost multi-directions sockets in the first raw and connect its free end to a plug 100 at first. Then use the electric wire 14 from the same socket to sequential go around all the sockets in the same raw and until it reaches to a lowermost socket which is upride down relative to the other sockets in the row and is held respectively by the hooks 18 and 28, then goes upward to be held by the hook 18 of the upmost socket and then goes around to the second, third and four rows and finally conjugates together with electric wire 24 into the plug 100. So that a curtain of Christmas lights is therefore accomplished.

Figure 8:
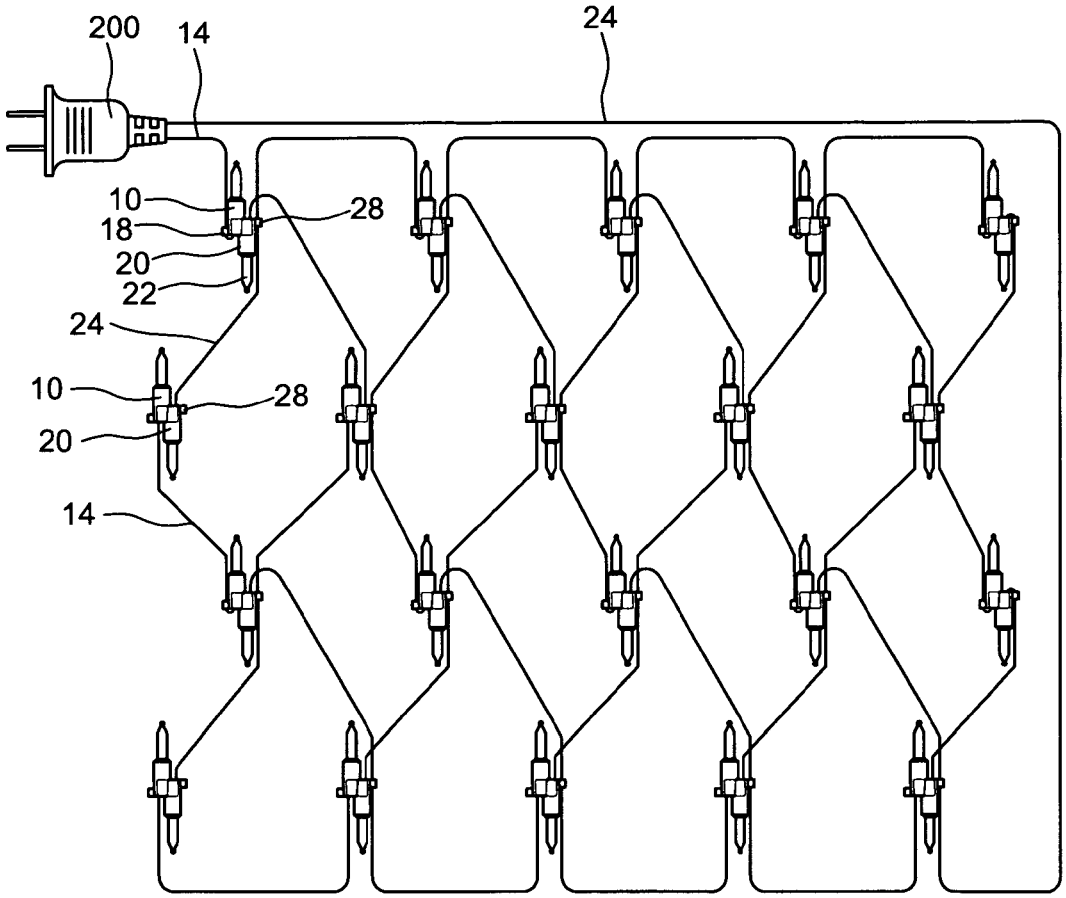
FIG. 8 is a plane view that the multi-directions sockets of FIG. 6 are reticulated into a network.

FIG. 8 shows that a electric wire 14 from the socket 10 held by the hook 18 connects to a plug 200 and an electric wire 24 from the second socket 20 connects a second socket 20 at the left lower position and after held by the hook 28 of that socket 20 and an electric wire 14 from the socket 10 of that left lower positioned multi-direction socket goes around the additional multi-directions sockets with the electric wire 24 and finally, the electric wires conjugate together to connect with plug 200. A network of the Christmas light is therefore reticulated.

Figure 9:
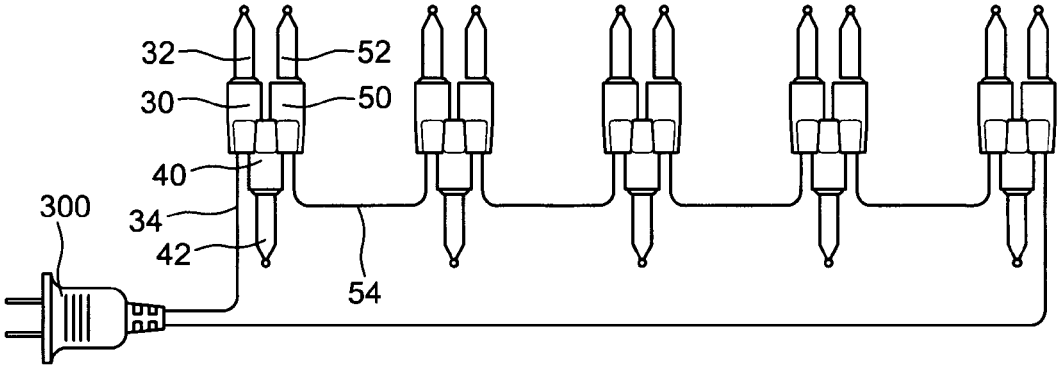
FIG. 9 is a plane view to show a third embodiment of the multi-directions sockets in a string of Christmas lights.

FIG. 9 shows a third embodiment of the multi-direction socket which is alternately and juxtaposedly integrated with three socket 30, 40 and 50 (actually, this multi-directional socket can be combined with four or first alternate socket or shaped into a ring or triangular configurations). The socket 40 is upside down relative to the other two socket 30 and 50. The middle socket 40 has a pair of contact plates and the other two socket 30 and 50 each has a contact plate at the top of a pair of the electric wires 34 and 54. Each of the sockets 30, 40 and 50 has a lamp 32, 42 and 52 in their rims.

The electric wires 34 and 54 make a series circuit through the additional multi-directions socket and finally conjugate together to connect with plug 300.

Figure 10:
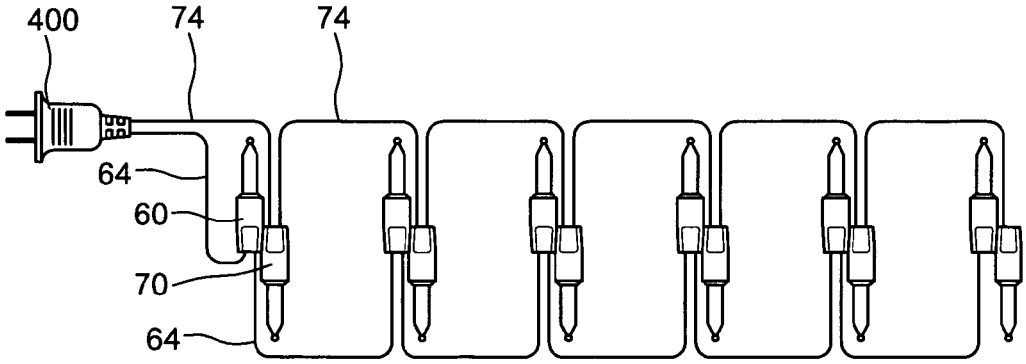
FIG. 10 is a plane view to show a third embodiment of the multi-directions sockets in a string of Christmas lights.

FIG. 10 shows an alternate multi-directions socket similar to that of the first embodiment.

But both the first socket 60 and the second socket 70 are independent with each other and each has a pair of electric wires 64 and 74 with contact plate at their inner ends. When makes a string of Christmas lights, conjugate the one of the electric wires 64 of the first socket 60 and the one of the electric wires 74 of the second socket 70 together into a plug 400. Then connects the another wire 64 from the first socket 60 into the first socket 60 of a second multi-directions socket and the another wire 74 from the second socket 70 connects to a second socket 70 of the second multi-direction socket. An electric circuit is therefore formed. If does it continuously, a string of Christmas lights is accomplished. The light string is also able to reticulate a curtain of network of lights in different shapes.

Figure 11:
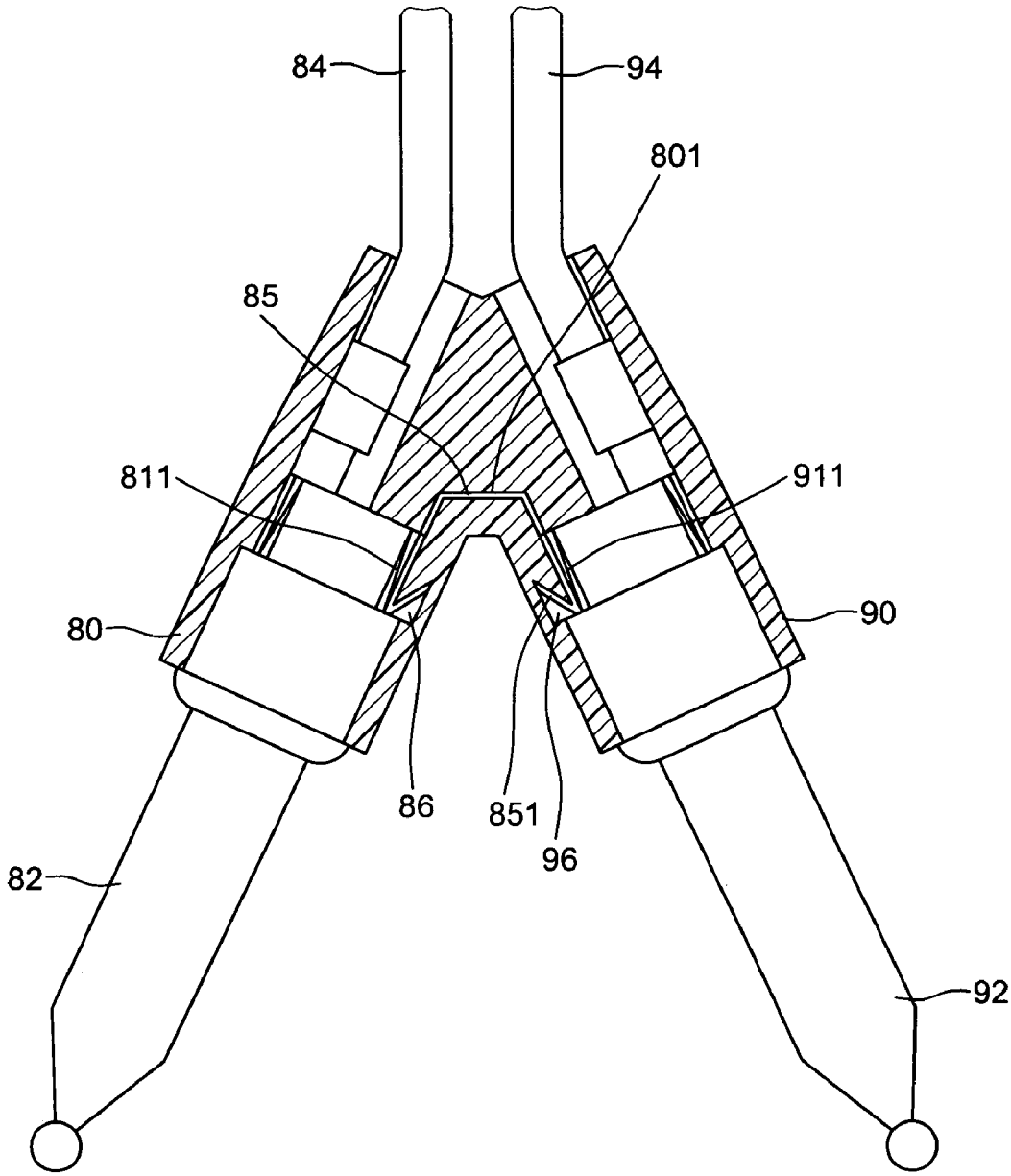
FIG. 11 is a sectional view to show a fourth embodiment of the multi-directions socket of the present invention.

FIG. 11 presents a fourth embodiment of the multi-directions socket of the present invention which is combined with a first socket 80 and a second socket 90 and slantwise integrated with each other on the lower portions so as to form a roughly inverse V-shaped section of about 45°. A roughly inverse U-shaped slender slit 801 communicating into the two socket 80 and 90 with a pair of triangular retaining spaces 86 and 96 in two ends for engaging a roughly inverse U-shaped slender copper plate 85 therewithin having a hook 851 at each end retained in the retaining spaces 86 and 96 respectively. A pair of electric wires 84 and 94 each has a contact plate at their inner end respectively inserted into the bottoms secured in an inner wall of the first and second socket 80 and 90 positioned opposite to the slender copper plate 85 and a pair of lamps 82 and 92 insert into the sockets 80 and 90 each having a pair of lead-in wires 811 and 911 attached on their bases and respectively engaged with the contact plates and the slender copper plate 85 to form an electric circuit in the sockets 80 and 90 for lightening the lamps 82 and 92.

This invention is principally presenting the prominent feature of the multi-directions socket which can be turned upside down or to form a V-shaped or L-shaped configurations and aims to provide a three-dimensional effect to the user. Therefore breaking through the defects of the connectional single socket or the combined two sockets.

Note that the specification relating to the above embodiments should be construed as an exemplary rather than as a limitative of the present invention, with many variations and modifications being readily attainable by a person of average skill in the art without departing from the spirit or scope thereof as defined by the appended claims and their legal equivalents.

I claim:

1. A structure of multi-directions socket for Christmas light comprising:

a pair of first and second sockets alternately and juxtaposedly integrated with one another toward opposite directions, a vertical slender slit formed thereinbetween including a triangular retaining space in lower end inside said second socket for disposing a common slender copper plate which has a hooked lower end retained by said triangular retaining space and a contact upper end engaged in an inner wall of said first socket, a pair of electric wire each having contact plate at inner end respectively inserted into said first and second sockets and secured to an inner wall thereof opposite to the contact upper end and the hooked lower end of said slender copper plate and a pair of lamps respectively inserted into an upper and lower rim of said first and second sockets each having a base, a bulb and pair of lead-in wires attached to outer surface of the base and respectively contacted with the contact plates and the slender copper plate inside said first and second sockets for establishing an electric circuit between said sockets.

2. The structure as recited in claim 1, wherein said multi-directions socket can be reticulated into a string of Christmas lights and several combined strings of Christmas lights.

3. The structure as recited in claim 1, wherein said multi-directions socket can be made with out a common slender copper plate and each has a pair of electric wires a contact plate at their inner ends.

4. A structure of multi-directions socket for Christmas light comprising:

a pair of first and second sockets alternately and juxtaposedly integrated with one another toward opposite directions, a vertical slender slit formed thereinbetween including a triangular retaining space in lower end in said second socket for disposing a common slender copper plate which has a hooked lower end retained by the retaining space of said second socket and a contact upper end engaged in an inner wall of said first socket, a pair of hooks respectively formed on outer periphery of said first and second sockets, a pair of electric wires each having a contact plate at inner end respectively inserted into said first socket and a lower rim of the second socket and secured to an inner wall thereof opposite to the contact upper end and the hooked lower end of said slender copper plate and a pair of lamps respectively inserted into an upper rim of said first and second sockets each having a base, a bulb and a pair of lead-in wires attached to outer surface of the base and respectively contacted with the contact plate and slender copper plate inside said first and second socket for establishing an electric circuit between said sockets.

5. The structure as recited in claim 4, wherein said multi-directions socket facilitate to reticulate a curtain of Christmas lights and a network of Christmas lights.

6. A structure of multi-directions socket for Christmas light comprising:

three sockets alternately and juxtaposedly integrated with each other, wherein a socket at middle position is toward opposite directions relative to two side sockets, a common contactplate transversely disposed in said three socket, a pair of electric wires respectively inserted into bottom of said two side socket to establish an electric circuit in said three sockets each of which has a lamp inserted upper or lower rim and contacted said transverse common contact plate, one of said electric wires sequentially connected additional multi-directions sockets and the other one of said electric wires from an endmost multi-directions socket and conjugating together with said one electric wire connected into a plug to accomplish a string of Christmas lights.

7. A structure of multi-directions socket for Christmas light comprising:

a first and a second socket slantwise integrated with one another on their lower portions to form an inverse V-shaped section of about 45° angle, a U-shaped slender slit formed between said sockets and having a triangular retaining space in each of distal ends for disposing a U-shaped slender contact plate which has a hook at each end retained within said retaining space respectively in said first and second sockets, a pair of electric wires each having a contact plate at inner end respectively inserted into bottom and secured to an inner wall of each of said sockets positioned opposite to said U-shaped slender contact plate and a pair of lamps respectively inserted into lower rim of each of said sockets and each having a base, a bulb and a pair of lead-in wire attached to outer surface of said base and respectively contacted with the contact plates of said electric wires and said U-shaped slender contact plate to establish an electric circuit within said first and second sockets.

* * * * *